US008639175B2

(12) United States Patent
Goto

(10) Patent No.: US 8,639,175 B2
(45) Date of Patent: Jan. 28, 2014

(54) CURL CORRECTING DEVICE, IMAGE FORMING APPARATUS, AND SHEET POST-PROCESSING DEVICE

(75) Inventor: Takeshi Goto, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 434 days.

(21) Appl. No.: 12/591,723

(22) Filed: Nov. 30, 2009

(65) Prior Publication Data

US 2010/0135708 A1 Jun. 3, 2010

(30) Foreign Application Priority Data

Dec. 2, 2008 (JP) ..... 2008-307221

(51) Int. Cl.
*G03G 15/00* (2006.01)
*B65H 31/00* (2006.01)

(52) U.S. Cl.
USPC ..... 399/406; 271/209

(58) Field of Classification Search
USPC ..... 399/68, 122, 67, 406, 322, 323, 400; 271/161, 188, 209
See application file for complete search history.

(56) References Cited

U.S. PATENT DOCUMENTS

| | | | | |
|---|---|---|---|---|
| 5,933,698 | A * | 8/1999 | Muramatsu | 399/406 |
| 5,966,158 | A * | 10/1999 | Ebata et al. | 347/104 |
| 6,505,833 | B2 * | 1/2003 | Kato et al. | 271/272 |
| 6,988,729 | B2 | 1/2006 | Tamura et al. | |
| 7,216,865 | B2 | 5/2007 | Tamura et al. | |
| 7,306,214 | B2 | 12/2007 | Iida et al. | |
| 2007/0235917 | A1 | 10/2007 | Nagasako et al. | |
| 2008/0217837 | A1 | 9/2008 | Nagasako et al. | |
| 2009/0057978 | A1 | 3/2009 | Maeda et al. | |

FOREIGN PATENT DOCUMENTS

| | | |
|---|---|---|
| JP | 09-006073 | 1/1997 |
| JP | 2000-247526 | 9/2000 |
| JP | 2005-096892 | 4/2005 |
| JP | 2007-119193 | 5/2007 |

OTHER PUBLICATIONS

Office Action dated Oct. 23, 2012 by the Japanese Patent Office for Japanese application JP2008-307221.

* cited by examiner

*Primary Examiner* — Judy Nguyen
*Assistant Examiner* — Justin Olamit
(74) *Attorney, Agent, or Firm* — Harness, Dickey & Pierce, P.L.C.

(57) ABSTRACT

A curl correcting unit can be attached in a normal orientation and inverse orientation. In the normal orientation, a sponge roller being on the lower side, a sliding plate is pressed down by a curl-correction-amount adjusting mechanism. When the sliding plate is pressed down, a roller-side plate is lifted up via a link, where the link works as a shaft of a seesaw that connects the sliding plate and the roller-side plate. As a result, the sponge roller moves up and comes into press-contact with a metallic roller. In the inverse orientation, the sponge roller being on the upper side, the roller-side plate is directly pressed down by the curl-correction-amount adjusting mechanism and thereby the sponge roller comes into press-contact with the metallic roller.

11 Claims, 6 Drawing Sheets

CURL CORRECTING DEVICE, IMAGE FORMING APPARATUS, AND SHEET POST-PROCESSING DEVICE

CROSS-REFERENCE TO RELATED APPLICATIONS

The present application claims priority to and incorporates by reference the entire contents of Japanese Patent Application No. 2008-307221 filed in Japan on Dec. 2, 2008.

BACKGROUND OF THE INVENTION

1. Field of the Invention

The present invention relates to a curl correcting device that corrects curl on a paper sheet, and an image forming apparatus and a sheet post-processing device that employ the curl correcting device.

2. Description of the Related Art

A post-processing device is sometimes connected to an image forming apparatus. The post-processing device aligns each set of image-formed paper sheets that are discharged from the image forming apparatus and performs various post-processes on the paper sheets. Such post-processes include stapling or punching.

The post-processing can not be performed in a desirable manner if the paper sheets are curled. Heat and pressure are applied to paper sheets in the image fixing process performed in image forming apparatuses. The paper sheets get curled when heat and pressure are applied to them.

The paper sheets can curl in a random direction (hereinafter, "curling direction") depending on the type of material of the paper sheets. However, conventional curl correcting devices can correct curls made on only standard paper sheets. That is, the conventional curl correcting devices cannot adequately correct curls made on, for example, thick sheets or non-standard sheets. On top of this, the conventional curl correcting devices may even curl the paper sheet in an opposite direction if the effect of the correction is too large.

Use of curl corrected/removed paper sheets decreases the number of jams of paper sheets under conveying and allows the preferable post-processing that is a subsequent process of the curl correcting process, which improves the quality of the post-processing significantly.

Various devices that remove curl from paper sheets have been proposed. For example, Japanese Patent Application Laid-open No. 2007-119193 discloses a curl removing device that can correct curls in various directions. Japanese Patent Application Laid-open No. 2000-247526 discloses a curl correcting device that can adjust linear speed depending on the conveyance path and includes a loop space that allows a paper sheet to bend. Japanese Patent Application Laid-open No. H9-6073 discloses a technology in which the amount of curl correction is adjusted depending on the degree of curl.

The conventional technologies require complicated structures for correcting the curl.

For example, the technology disclosed in Japanese Patent Application Laid-open No. 2000-247526 that removes curl depending on the curling direction needs conveyance paths corresponding to different curling directions and a curl correcting roller arranged in each of the conveyance paths in such a manner that the conveyance paths can be switched by operation of a switching claw. Therefore, a large space is needed for arranging the two conveyance paths and the switching claw in the device. There is a demand for a simplified configuration.

SUMMARY OF THE INVENTION

It is an object of the present invention to at least partially solve the problems in the conventional technology.

According to an aspect of the present invention there is provided a curl correcting device in which a soft roller and a hard roller having different degrees of hardness make a nip in such a manner the soft roller is in press-contact with the hard roller with the soft roller being depressed, the curl correcting device correcting curl on a paper sheet by causing the paper sheet to pass through the nip. The curl correcting device includes an inter-shaft distance adjusting unit that prolongs/shortens a distance between shafts of the soft roller and the hard roller; and a casing that supports both the soft roller and the hard roller and is attached to a main body in a detachable manner, wherein the casing can be attached in both a normal orientation and an inverse orientation in which positions of the hard roller and the hard roller with respect to a paper-sheet conveyance path is inverse relative to those in the normal orientation.

According to another aspect of the present invention there is provided an image forming apparatus including an image forming unit that performs image forming on a paper sheet; a discharge unit that discharges the paper sheet after the image forming; and the above curl correcting device that receives the paper sheet from the discharge unit and corrects curl on the paper sheet.

According to still another aspect of the present invention there is provided a sheet post-processing device that is connected to an image forming apparatus that includes an image forming unit that performs image forming on a paper sheet and a discharge unit that discharges the paper sheet after the image forming. The sheet post-processing device includes a post-processing unit that performs post-processing on the paper sheet that is discharged from the image forming apparatus; and the above curl correcting device as a curl correcting unit that receives the paper sheet from the discharge unit of the image forming apparatus, corrects curl on the paper sheet, and conveys curl-corrected paper sheet to the post-processing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
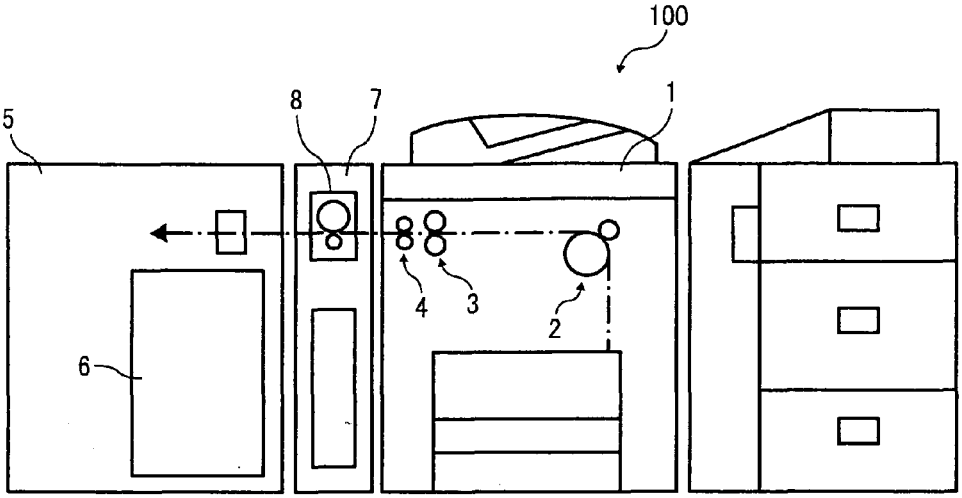
FIG. 1 is a schematic diagram of the configuration of an image forming system according to an embodiment of the present invention.

FIG. 1 is a schematic diagram of the configuration of an image forming system 100 according to an embodiment of the present invention.

The image forming system 100 includes an image forming apparatus 1, a curl correcting device 8, and a sheet post-processing unit 5.

The image forming apparatus 1 includes an image forming unit 2 that mainly includes photosensitive elements that electro-photographically form an image on a paper sheet; a fixing unit 3 that performs an image fixing process, i.e., fixes the image onto the paper sheet using heat and pressure; a discharge unit 4 that discharges the image-fixed paper sheet from the image forming apparatus 1.

The sheet post-processing unit 5 includes a large-volume stacker unit that stacks sets of paper sheets on a tray aligned set by set; and a processing unit 6 that performs various post-processes, such as stapling or punching.

The curl correcting device 8 is arranged between the image forming apparatus 1 and the sheet post-processing unit 5. The curl correcting device 8 includes a curl correcting unit 7 that corrects curl on the paper sheet received from the image forming apparatus 1 and passes the curl-corrected sheet to the sheet post-processing unit 5.

Figure 2:
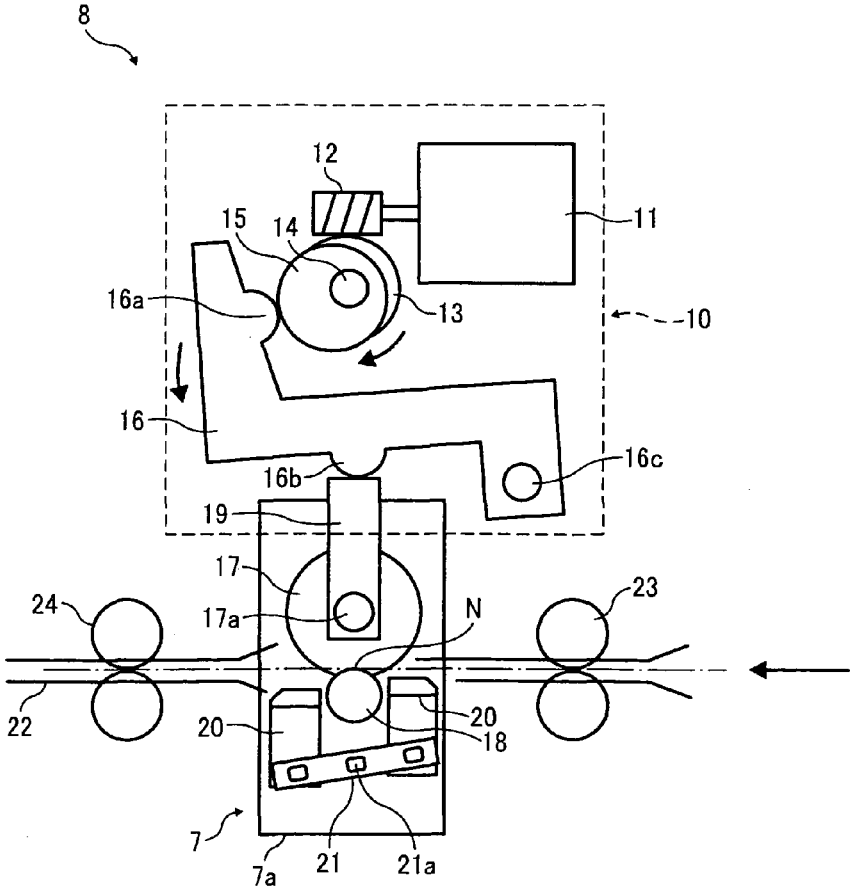
FIG. 2 is a schematic diagram of the relevant parts of a curl correcting device according to the present embodiment.

FIG. 2 is a schematic diagram of the relevant parts of the curl correcting device 8. The curl correcting device 8 includes the curl correcting unit 7 and a curl-correction-amount adjusting mechanism 10.

The curl-correction-amount adjusting mechanism 10 includes a curl-correction-amount adjusting motor 11; a worm gear 12 that is driven by the curl-correction-amount adjusting motor 11; an eccentric cam 15 that is attached to a supporting shaft 14 in which the supporting shaft 14 supports a gear 13 that is engaged with the worm gear 12; and an arm 16 one end of which is attached to a rotary shaft 16*c* and swings when the eccentric cam 15 presses against a predetermined part of the arm 16 called "receiving section 16*a*".

The curl correcting unit 7 is arranged under the curl-correction-amount adjusting mechanism 10. The curl correcting unit 7 includes a sponge roller 17 that is a soft roller; a metallic roller 18 that is a hard roller; a roller-side plate 19 that is fixed to a rotary shaft 17*a* of the sponge roller 17 and that is in contact with a pressing section 16*b* of the arm 16. With this structure, the roller-side plate 19 moves up and down with the movement of the arm 16, i.e., with the movement of the curl-correction-amount adjusting motor 11. The sponge roller 17 is in press-contact with the metallic roller 18 with the sponge roller 17 being depressed. That is, surfaces of the sponge roller 17 and the metallic roller 18 make a nip N. A paper sheet received from the image forming apparatus 1 passes through the nip N.

The curl correcting unit 7 further includes a pair of movable guiding plates 20 that are arranged near and on either sides of the nip N in such a manner the paper sheet can pass through near the upper ends of the movable guiding plates 20. Moreover, a movable-guiding-plate link 21 is provided that swings about a link shaft 21*a* so as to move the movable guiding plates 20 either close to or away from the paper-sheet conveyance path.

A guiding path 22 guides the paper sheet from the image forming apparatus 1 into the curl correcting device 8 and from the curl correcting device 8 to the sheet post-processing unit 5. A pair of entrance conveyance rollers 23 and a pair of exit conveyance roller 24 are arranged on both sides of the nip N in the guiding path 22 for conveying the paper sheet.

The ends of the sponge roller 17 and the metallic roller 18 are supported by side-wall sections 7*a* that are both side walls of the casing of the curl correcting unit 7 so that they are arranged inside the curl correcting unit 7 as a unit.

It is possible to attach the curl correcting unit 7 to the curl correcting device 8 in two way: normal orientation and inverse orientation. The normal orientation is the way the curl correcting unit 7 is attached to the curl correcting device 8 in FIG. 2. The inverse orientation is opposite to the normal orientation. In the inverse orientation, the metallic roller 18 is arranged above the sponge roller 17. Irrespective of whether the curl correcting unit 7 is attached in the normal or inverse orientation, the metallic roller 18 is displaced away from the paper-sheet conveyance path by the same distance.

Figure 3:
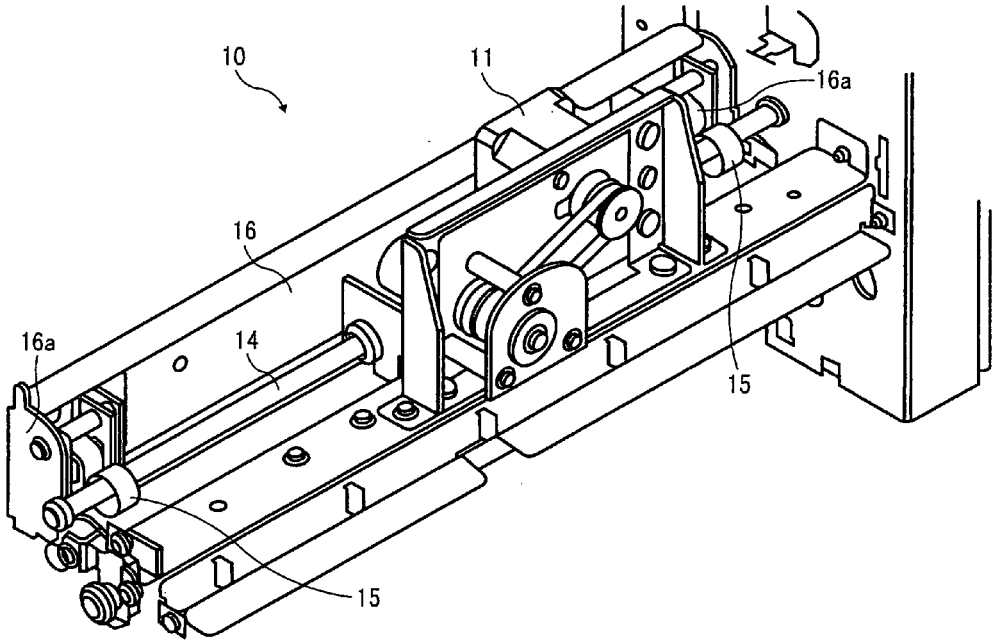
FIG. 3 is a perspective view of an eccentric cam and a supporting shaft in the curl correcting device according to the present embodiment.

As shown in FIG. 3, the eccentric cam 15 is attached to each end of the supporting shaft 14 and comes into contact with the receiving section 16*a* that is positioned at each end of the arm 16 running along the shaft direction of the sponge roller 17 and the metallic roller 18.

Figure 4:
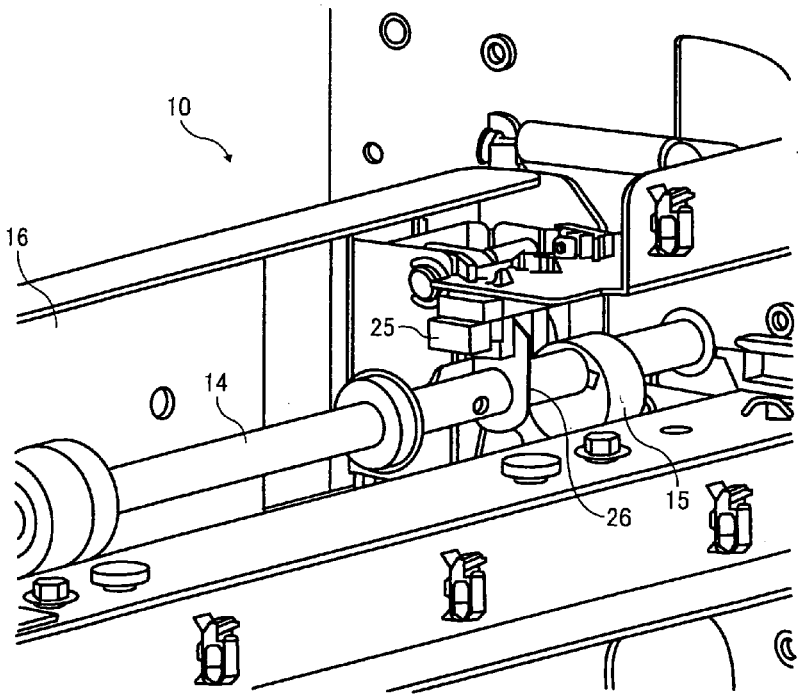
FIG. 4 is a perspective view of a home position sensor of the eccentric cam in the curl correcting device according to the present embodiment.

As shown in FIG. 4, a sensor filler 26 is provided on the supporting shaft 14. Moreover, a home position sensor 25 is provided to detect the home position of the sensor filler 26. The home position sensor 25 detects the rotating status of the eccentric cam 15 by using the sensor filler 26.

Figure 5:
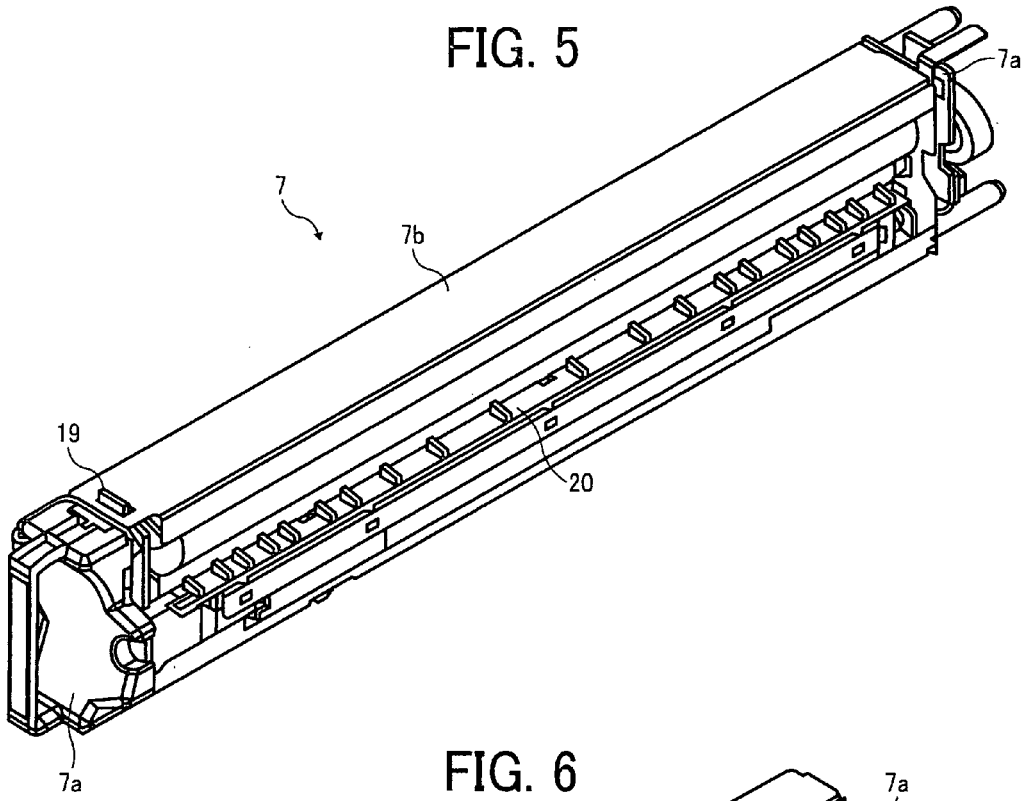
FIG. 5 is a general perspective view of a curl correcting unit according to the present embodiment.
Figure 6:
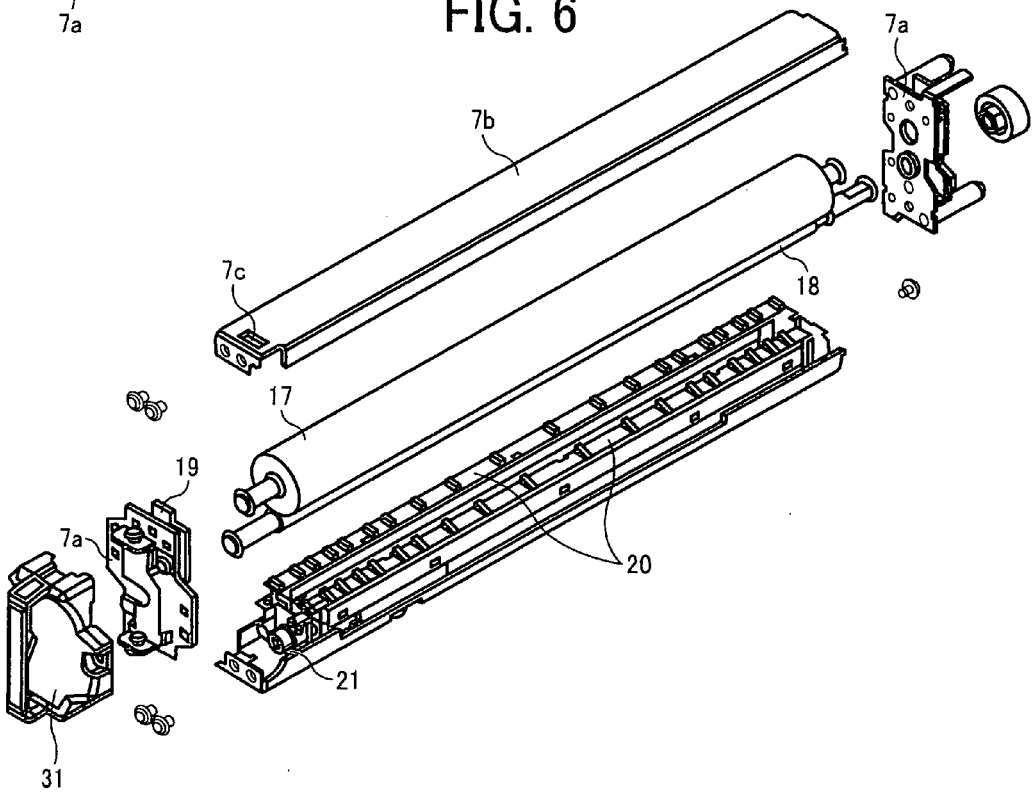
FIG. 6 is an exploded perspective view of the curl correcting unit according to the present embodiment.

FIG. 5 is a general perspective view of the curl correcting unit 7 and FIG. 6 is an exploded perspective view of the curl correcting unit 7. The casing of the curl correcting unit 7 is formed with the side-wall sections 7*a*, an upper plate 7*b*, and an outer frame 31. Various components, such as the sponge roller 17, the metallic roller 18, the roller-side plate 19, the movable guiding plates 20, and the movable-guiding-plate link 21, are arranged inside the casing of the curl correcting unit 7.

The upper plate 7*b* has a through hole 7*c*. When the roller-side plate 19 moves up, it comes out of the casing through the through hole 7*c*.

Figure 7:
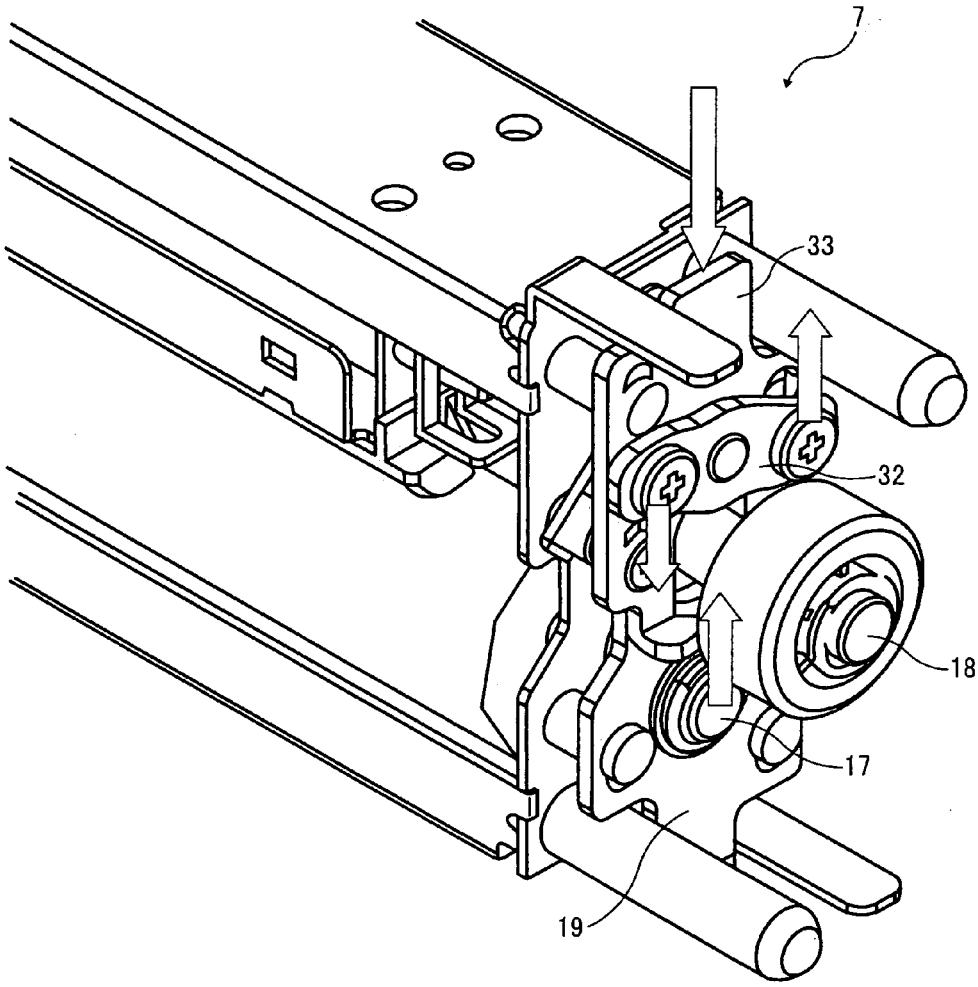
FIG. 7 is a perspective view of a pressing mechanism for a sponge roller according to the present embodiment.

FIG. 7 is a perspective view of a pressing mechanism for the sponge roller 17 when the curl correcting unit 7 is attached to the curl correcting device 8 in the inverse orientation. The curl correcting unit 7 includes a sliding plate 33 that is coupled to the roller-side plate 19 via a link 32. As described in more detail later, when the sliding plate 33 is pressed down, the roller-side plate 19 moves down, and therefore, the sponge roller 17 moves down, i.e., away from the metallic roller 18.

Figure 8A:
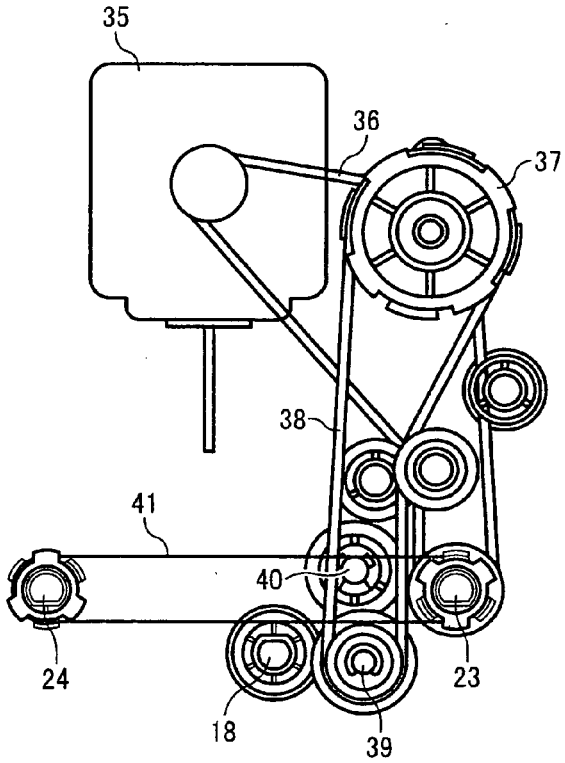
FIGS. 8A and 8B are schematic diagrams of the configuration of a roller driving system in the normal orientation and in the inverse orientation according to the present embodiment.
Figure 8B:
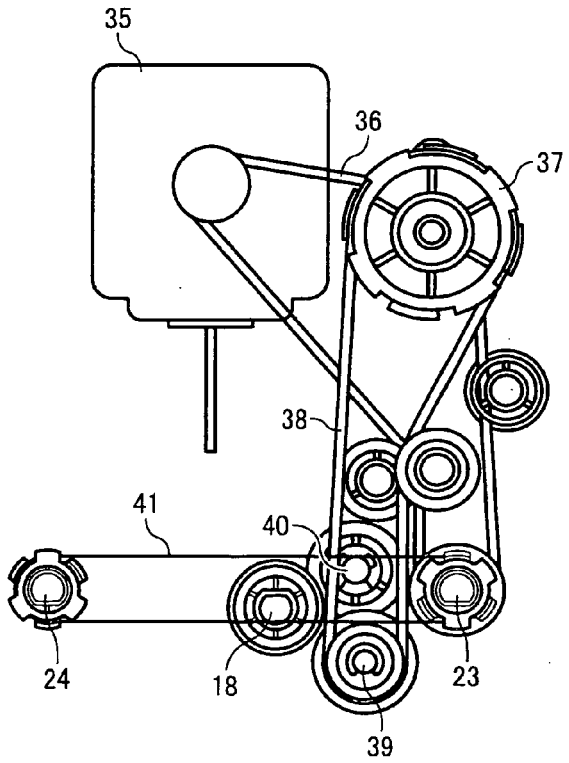

FIGS. 8A and 8B are schematic diagrams of the configuration of a roller driving system in the curl correcting unit 7. In the roller driving system shown in FIGS. 8A and 8B, the metallic roller 18 functions as a driving roller and the sponge roller 17 functions as a driven roller that rotates in association with the rotation of the metallic roller 18. As shown in FIG. 8A, the rotary driving force generated by a driving motor 35 is transmitted, via a first belt 36, a driving pulley 37, a second belt 38, and an intermediate pulley, etc., to a forward gear 39. The forward gear 39 is engaged with a gear that is attached to the metallic roller 18.

The forward gear 39 is also engaged with a reverse gear 40. When the metallic roller 18 moves up, the rotary driving force is transmitted from the reverse gear 40 to the metallic roller 18 as shown in FIG. 8B.

Moreover, the rotary driving force is transmitted to the entrance conveyance roller 23 via the first belt 36 and then transmitted to the exit conveyance roller 24 via a third belt 41.

Figure 9A:
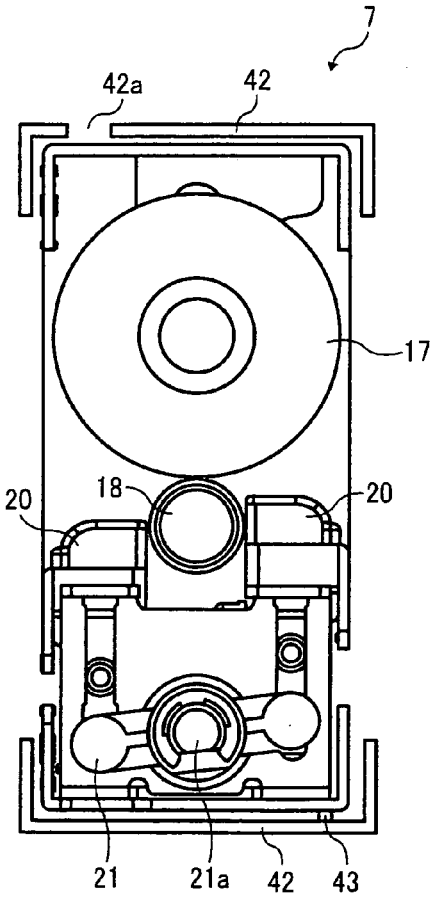
FIGS. 9A and 9B are side views of the curl correcting unit in the normal orientation and in the inverse orientation according to the present embodiment.
Figure 9B:
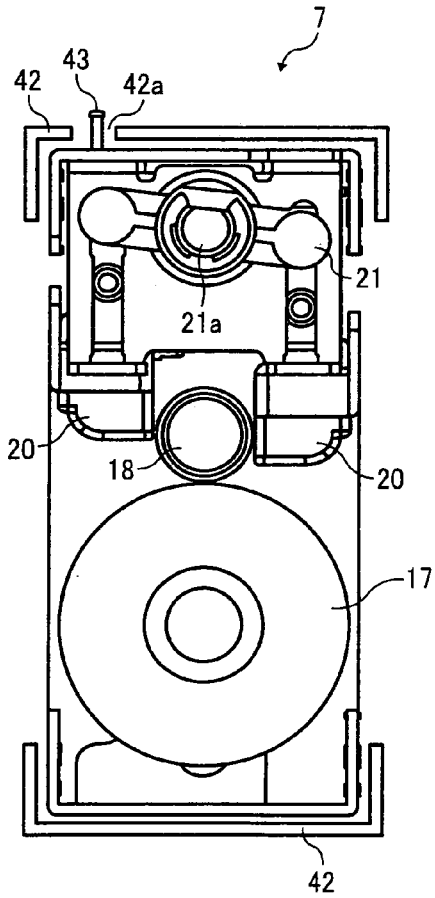

FIGS. 9A and 9B are side views of the relevant parts of the curl correcting unit 7. A guiding rail unit 42 is attached to each of the upper side and the lower side of the curl correcting unit 7. One of the guiding rail units 42 has a through hole 42*a*. A guiding-plate switching protrusion 43 protrudes out of the casing of the curl correcting unit 7 through the through hole 42*a*. The guiding-plate switching protrusion 43 swings the link shaft 21*a* of the movable-guiding-plate link 21.

Operations of the image forming system 100 according to the present embodiment are described below.

The user specifies a desired value as the curl correction amount using an operation/input panel of the image forming apparatus 1 shown in FIG. 1 and the specified value is set as the curl correction amount. More particularly, a control unit (not shown), such as a central processing unit (CPU), receives information about the specified value and outputs a control signal that includes the pulse number to the curl-correction-amount adjusting motor 11 that can be a step motor. The pulse number is determined based on the amount of rotation that needs to be made by the motor to correct the curl correction amount, i.e., the pulse number set the distance between the roller shafts.

As shown in FIG. 2, as the curl-correction-amount adjusting motor 11 rotates based on the pulse number in the control signal, the eccentric cam 15 rotates and presses against the receiving section 16*a* of the arm 16. The arm 16 swings about the rotary shaft 16*c* counter-clockwise and then presses down the roller-side plate 19 that is attached to the sponge roller 17 with the pressing section 16*b* coming into contact with the roller-side plate 19. When the roller-side plate 19 moves down, the sponge roller 17 comes into contact with the metallic roller 18 to such an extent that the sponge of the sponge roller 17 is depressed. As a result, the nip N is formed between both the rollers 17 and 18 in accordance with the specified curl correction amount.

The curl-correction-amount adjusting motor 11 starts to rotate the eccentric cam 15 of the curl-correction-amount adjusting mechanism 10 before the paper sheet enters the nip N and then stops so that when the paper sheet enters the nip N its curl is corrected. After the paper sheet passes out of the nip N, the curl-correction-amount adjusting motor 11 rotates in the reverse direction so that the eccentric cam 15 moves back to its home position. Whether the eccentric cam 15 is in the home position is detected by the detection of the sensor filler 26 by the home position sensor 25 shown in FIG. 4. Zero adjustment is performed by moving back the eccentric cam 15 to the home position at each end of operation, which allows correct adjustment of the amount of depression of the sponge roller 17 to the target amount.

If the curl correcting unit 7 is attached in such a manner that the sponge roller 17 is positioned on the upper side, i.e., the normal orientation as shown in FIG. 2, the roller-side plate 19 that connects the curl-correction-amount adjusting mechanism 10 and the sponge roller 17 is directly pressed down and then comes into press-contact with the metallic roller 18.

In contrast, if the curl correcting unit 7 is attached in such a manner that the sponge roller 17 is positioned on the lower side, i.e., the inverse orientation as shown in FIG. 7, the curl-correction-amount adjusting mechanism 10 presses the sliding plate 33 down, thereby moving the roller-side plate 19 up via the link 32, where the link 32 works as a shaft of a seesaw that connects the sliding plate 33 and the roller-side plate 19. The sponge roller 17 thereby moves down and away from the metallic roller 18.

As shown in FIGS. 9A and 9B, the pair of movable guiding plates 20 arranged near both sides of the nip N of the metallic roller 18 move in directions opposite to each other via the movable-guiding-plate link 21 depending on the orientation of the attached curl correcting unit 7. That is, when one of the plates moves closer to the paper-sheet conveyance path, the other of the plates moves away from the paper-sheet conveyance path. In other words, by the operation of the movable-guiding-plate link 21, one of the movable guiding plates 20 on the entrance side (the right side of the figure) moves up and the other movable guiding plate 20 on the exit side moves down. This prevents the leading edge of the paper sheet from coming into contact with the movable guiding plate 20 and therefore allows smooth paper-sheet conveyance.

The movement of the movable guiding plates 20 is performed depending on the orientation of the attached curl correcting unit 7 whether the guiding-plate switching protrusion 43 is pressed down by the guiding rail unit 42 (FIG. 9A) or the guiding-plate switching protrusion 43 goes out through the through hole 42*a* of the guiding rail unit 42 without being pressed (FIG. 9B).

In other words, the up-and-down movement of the guiding-plate switching protrusion 43 is associated with the swing of the link shaft 21*a*. By the operation of the guiding-plate switching protrusion 43, the link shaft 21*a* swings forwards or backwards and the movable-guiding-plate link 21 swings. This switches between the entrance side position and the exit side position of the movable guiding plates 20.

With the above configuration, rollers that are in press-contact with each other securely make a nip to correct curl.

With the above configuration, because an arm member and a cam member are arranged to press both ends of a soft roller down, the both ends of the soft roller go down by the same amount and therefore the soft roller is evenly deformed.

With the above configuration, because an inter-shaft distance can be adjusted even when the casing of a curl correcting unit is attached in an inverse orientation, the performance of curl correcting is not affected by the orientation of the attached casing.

With the above configuration, because the position of a hard roller is fixed, settings concerning the degree of press-contact on the soft roller or the like are stabilized.

Because a forward gear and a reverse gear are used in this configuration, the soft and hard rollers can be driven without changing, for example, the manner of operation of the motor that works as a driving source. Moreover, because the direction of rotation of the motor does not need to be changed, it is possible to drive both the soft and hard rollers and a conveyance roller with a single motor.

If the soft roller works as the driving roller, the diameter of the soft roller decreases as the soft roller is significantly deformed, and the excessive deformation may cause the paper sheet to have a crease. In contrast, if the hard roller works as the driving roller, the paper sheet is conveyed at a fixed speed regardless of the degree of the deformation.

With the above configuration, a movable guiding member on the sheet entrance side is arranged near the nip so as to allow the paper sheet to enter the nip smoothly. Another movable guiding member on the sheet exit side is in a retraction position to prevent a paper jam caused by the paper sheet that has passed through the nip hitting the movable guiding member. This allows smooth passage of the paper sheet.

With the above configuration, the intra-shaft distance, i.e., the status of deformation of the soft roller can be adjusted accurately using pulse control.

With the above configuration, preferable pulse control is implemented in a simple manner.

In the curl correcting device according to the present embodiment, it is possible to easily appropriately change the positions of the rollers depending on various types of curl so as to perform preferable curl correction, while suppressing the space for the curl correcting device. If the curl correcting device is used in the discharge unit 4 of the image forming apparatus 1 shown in FIG. 1 or arranged upstream of the sheet post-processing unit 5 in the paper-sheet conveyance direction, the reliability of the image formation will be improved and preferable post-processing will be performed.

In a curl correcting device according to the present invention, a soft roller and a hard roller are provided within a single unit so as to deal with different curling directions frontside and backside of a paper sheet and the single unit is attachable in both a normal orientation and an inverse orientation. Therefore, the curl correcting device can correct various conditions of curls made on various types of paper sheets. Because of this integrated construction, the curl correcting device needs only the minimum layout space in the device and therefore the present invention does not lead to an increase in the size of the device. Moreover, it is easy to invert the rollers.

An image forming apparatus according to the present invention smoothly discharges image-formed paper sheets without an error caused by curling paper sheets. Therefore, the reliability of the image forming apparatus is improved.

A sheet post-processing device according to the present invention smoothly conveys paper sheets that are discharged from an image forming apparatus to a post-processing unit without an error caused by curling paper sheets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A curl correcting device in which a soft roller and a hard roller having different degrees of hardness make a nip in such a manner the soft roller is in press-contact with the hard roller with the soft roller being depressed, the curl correcting device correcting curl on a paper sheet by causing the paper sheet to pass through the nip, the curl correcting device comprising:

an inter-shaft distance adjusting unit that is equipped with a main body, and prolongs/shortens a distance between shafts of the soft roller and the hard roller; and a casing that is arranged close to the inter-shaft distance adjusting unit and is attached to the main body in a detachable manner, the casing includes the soft roller, the hard roller, and a support member, in which the support member supports one roller of the soft roller and the hard roller and is movable in an upwardly or a downwardly direction with the movement of the inter-shaft distance adjusting unit, and a link mechanism being engaged with the support member, wherein:

the casing can be attached to the main body in both a normal orientation and an inverse orientation in which positions of the soft roller and the hard roller with respect to a paper-sheet conveyance path is inverse relative to those in the normal orientation, when the casing is attached in such a manner that the one roller is positioned close to the inter-shaft distance adjusting unit, the support member is moved by pushing a part of the support member via the inter-shaft distance adjusting unit so that the one roller comes into press-contact with the other roller, wherein the part of the support member is outside of the casing, when the casing is attached in such a manner that the other roller is positioned close to the inter-shaft distance adjusting unit, the support member is moved via the link mechanism by pushing the link mechanism from the outside of the casing via the inter-shaft distance adjusting unit so that the one roller comes into press-contact with the other roller, and a direction where the inter-shaft distance adjusting unit pushes the support member is the same as a direction where the inter-shaft distance adjusting unit pushes the link mechanism.

2. The curl correcting device according to claim 1, wherein the soft roller is a sponge roller and the hard roller is a metallic roller.

3. The curl correcting device according to claim 1, wherein the inter-shaft distance adjusting unit includes an arm member that presses both ends of either the soft roller or the hard roller;

a cam member that moves the arm member; and a driving source that drives the cam member.

4. The curl correcting device according to claim 1, wherein a distance between the hard roller and the paper-sheet conveyance path in the vertical direction is set to be the same in both the normal orientation and the inverse orientation.

5. The curl correcting device according to claim 1, wherein either the soft roller or the hard roller functions as a driving roller and other roller functions as a driven roller, and the curl correcting device further comprising two gear systems that transmit rotary force generated by a driving source to the driving roller so that the driving roller that is in a position of the normal orientation or a position of the inverse orientation can rotate both forward and backward.

6. The curl correcting device according to claim 5, wherein the hard roller is the driving roller and the soft roller is the driven roller.

7. The curl correcting device according to claim 1, further comprising:

movable guiding members that are arranged on either side of the nip in paper-sheet conveyance path; and an actuating member that moves, in the normal orientation and the inverse orientation, a movable guiding member that is on a sheet entrance side to a position on the paper-sheet conveyance path near the nip while moving a movable guiding member on a sheet exit side to a retracted position so that a leading edge of the paper sheet cannot come into contact with the movable guiding member on the sheet exit side.

8. The curl correcting device according to claim 1, wherein the inter-shaft distance adjusting unit adjusts the distance between the shafts of the soft roller and the hard roller on the basis of the number of pulses that are input to a driving source so that the distance can be set to a desirable value.

9. The curl correcting device according to claim 8, wherein the driving source is a stepping motor.

10. An image forming apparatus comprising:

an image forming unit that performs image forming on a paper sheet;

a discharge unit that discharges the paper sheet after the image forming; and the curl correcting device according to claim 1 that receives the paper sheet from the discharge unit and corrects curl on the paper sheet.

11. A sheet post-processing device that is connected to an image forming apparatus that includes an image forming unit that performs image forming on a paper sheet and a discharge unit that discharges the paper sheet after the image forming, the sheet post-processing device comprising:

a post-processing unit that performs post-processing on the paper sheet that is discharged from the image forming apparatus; and the curl correcting device according to claim 1 as a curl correcting unit that receives the paper sheet from the discharge unit of the image forming apparatus, corrects curl on the paper sheet, and conveys curl-corrected paper sheet to the post-processing unit.

* * * * *